United States Patent [19]

Izui et al.

[11] Patent Number: 5,027,701

[45] Date of Patent: Jul. 2, 1991

[54] BINDING MACHINE

[75] Inventors: Masaru Izui, Kakogawa; Akimitsu Hara, Akashi, both of Japan

[73] Assignee: Takigawa Kogyo Co., Ltd., Hyogo, Japan

[21] Appl. No.: 531,704

[22] Filed: Jun. 1, 1990

Related U.S. Application Data

[63] Continuation of Ser. No. 343,383, Apr. 26, 1989, abandoned.

[51] Int. Cl.[5] ..... B65B 13/28

[52] U.S. Cl. ..... 100/26; 100/31

[58] Field of Search ..... 100/13, 16, 26, 29, 100/31, 4, 25

[56] References Cited

U.S. PATENT DOCUMENTS

| | | | |
|---|---|---|---|
| 3,234,870 | 2/1966 | Missioux | 100/26 |
| 3,279,355 | 10/1966 | Missioux | 100/26 |
| 3,470,813 | 10/1969 | Nomm et al. | 100/26 X |
| 3,527,157 | 9/1970 | Elineau | 100/31 X |
| 3,557,684 | 1/1971 | Glasson | 100/26 |
| 4,252,157 | 2/1981 | Ohnishi | 100/31 X |
| 4,508,030 | 4/1985 | Grenon | 100/26 |

FOREIGN PATENT DOCUMENTS

| | | | |
|---|---|---|---|
| 470138 | 1/1929 | Fed. Rep. of Germany | 100/26 |
| 248024 | 7/1987 | Fed. Rep. of Germany | 100/31 |
| 51-30513 | 9/1976 | Japan . | |
| 55-29851 | 8/1980 | Japan . | |
| 58-171316 | 10/1983 | Japan . | |
| 64-23908 | 1/1989 | Japan | 100/31 |
| 64-23909 | 1/1989 | Japan | 100/31 |
| 64-70319 | 3/1989 | Japan | 100/31 |
| 1145581 | 3/1969 | United Kingdom | 100/31 |

*Primary Examiner*—Harvey B. Hornsby
*Assistant Examiner*—Stephen F. Gerrity
*Attorney, Agent, or Firm*—Birch, Stewart, Kolasch & Birch

[57] ABSTRACT

In a binding machine for binding bundles of elongate articles, a switchover device for switching between a one-loop mode and a two-loop mode is provided. The switchover device is moved fore and aft relative to the twisting head of the binding machine so as to place the switchover device into a first position and a second position. In the first position, a binding wire is guided through a guide way into first and second annular passages therein, thereby making two loops around the elongate articles. In the second position, the binding wire is guided through the guide way into only the first annular passage therein, thereby making a single loop around the elongate articles.

2 Claims, 5 Drawing Sheets

BINDING MACHINE

This application is continuation application of U.S. Ser. No. 07/343,383, filed Apr. 26, 1989, now abandoned.

BACKGROUND OF THE INVENTION (1) Field of the Invention

The invention relates to a binding machine which is adapted to bind elongate articles by means of a wire.

(2) Description of Prior Art

There are known some types of binding machines, examples thereof being those which are disclosed in the U.S. Pat. No. 3,234,870; ibid. 3,470,813; ibid. 3,557,684; and ibid. 4,252,157; the Japanese Patent Kokai No. 58-171316; the Japanese Patent Kokoku No. 51-30513; and ibid. 55-29851. The known binding machines generally comprise a pair of semicircular shells which form an annular wire guide. A binding wire travels along the wire guide and around a bundle of elongate articles which are to be bound.

The known binding machines also comprise means for feeding the binding wire, means for detecting a leading end of the binding wire, means for stretching said wire, and means for cutting and simultaneously twisting said wire.

The U.S. Pat. No. 3,234,870 to J. Missioux discloses such a machine that has a continuous helical passageway of two continuous loops guiding the wire around the articles which are to be bound. This machine, however, does not comprise any simple mechanism for switchover of a state of the passageway from two-loop mode to one-loop mode, or vice versa.

On the other hand, there is a demand for such a switchover mechanism because there are many kinds of articles which are lighter in their weight and can securely be bound by a single loop of binding wire.

SUMMARY OF THE INVENTION

Therefore, it is an object of the invention to provide a binding machine which comprises: a pair of semicircular shells forming a continuous wire guide including a first annular passageway and a second annular passageway, one of the semicircular shells pivoting on an axis to openably close the other semicircular shell so as to form said continuous wire guide; feeding means for feeding a binding wire to the wire guide; detecting means for detecting a leading end of the binding wire when the leading end has passed the wire guide; stretching means for stretching the binding wire after the leading end of said wire has been fixed to a surface portion of a twisting head; cutting means for cutting a trailing end of the binding wire, the trailing end being positioned at the surface portion of the twisting head; twisting means for twisting said leading end and said trailing end of the binding wire, the twisting means comprising the twisting head and a first actuator for rotating said twisting head, said twisting means adapted to twist said ends together simultaneously when the cutting means cuts said trailing end; a switchover device located adjacent to the twisting head and comprising a first guiding way and a second guiding way, the switchover device being moved fore and aft relative to the twisting head by means of a second actuator, so as to make a switchover between a first position and a second position of said switchover device, wherein the first position of said switchover device causes the first guiding way thereof to be aligned with both of the first and second annular passageways, while the second position of said switchover device causes the second guiding way to be aligned only with the first helical passageway of said annular wire guide.

According to the invention, the switchover device plays an important roll in the the binding machine. Said device is reversibly shifted in an axial direction of the continuous wire guide, from its first position to its second position, if and when the binding of elongate articles is done with a single loop of binding wire. A power cylinder as the second actuator may be of a hydraulic type or of a pneumatic type.

BRIEF DESCRIPTION OF THE DRAWINGS

The invention will become more apparent in the detailed description made hereinafter referring to the drawings, in which.

DETAILED DESCRIPTION OF PREFERRED EMBODIMENTS

A binding machine in an embodiment of the invention comprises a housing 1 having an upper compartment which houses a wire feeding assembly 2. The assembly 2 comprises a drum **2*a* which rotates on its own axis and engages with guide rollers 2*b*. A binding wire "A" enters the compartment through an inlet 2*d*, and is then gripped between a peripheral surface of the drum 2*a* and the guide rollers 2*b*. The binding wire "A" which is thus driven to advance along said peripheral surface runs through an outlet 2*c* toward a twisting head 3*a***.

Figure 1:
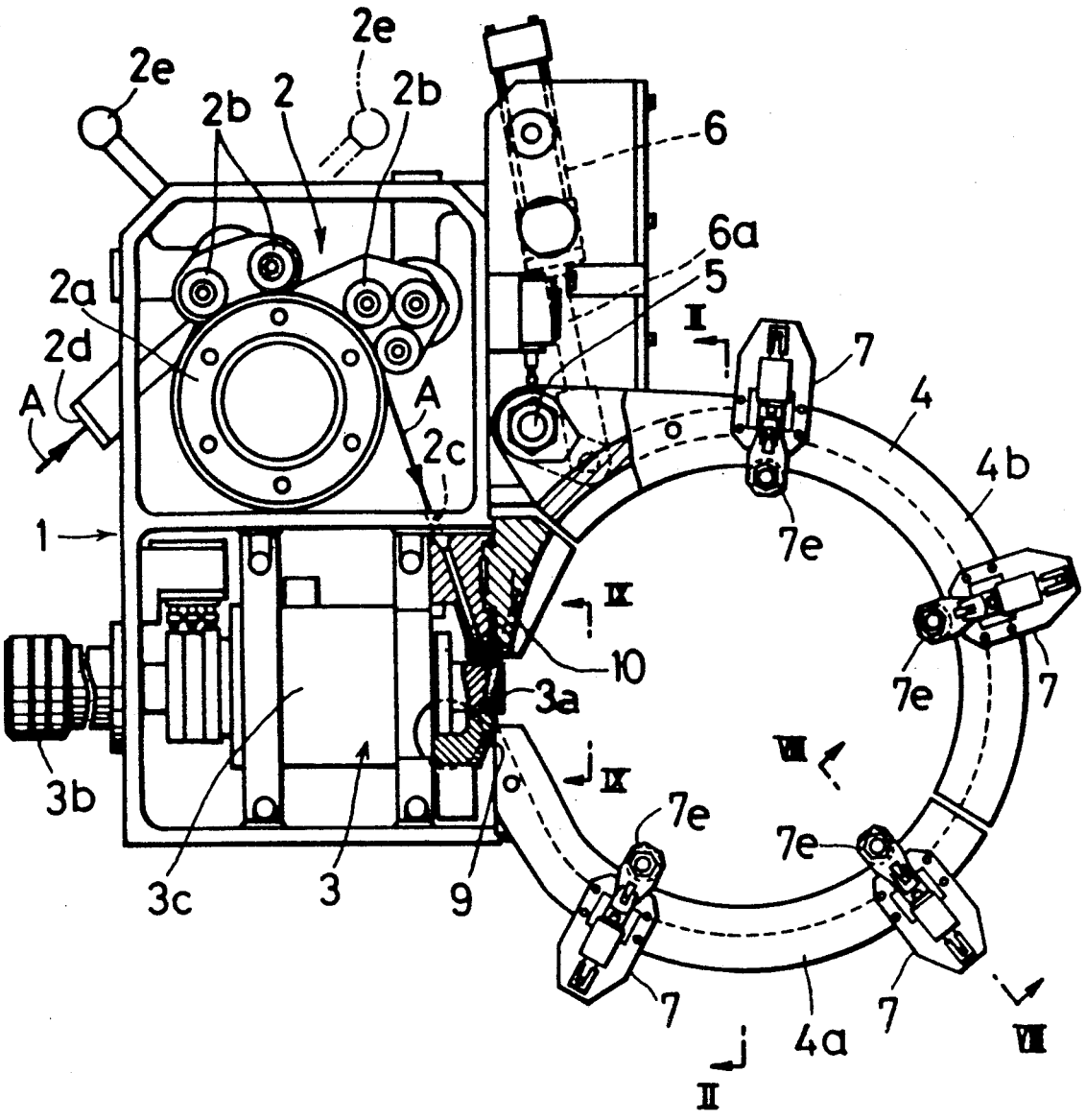
FIG. 1 is a side elevation of a binding machine in an embodiment of the invention.

The gripping action of the guide rollers **2*b* can be released, when necessary, by shifting a lever 2*e* from a position shown by a solid line to another position shown by a phantom line in FIG. 1**.

Twisting means 3 comprising the twisting head **3*a* comprises further a first actuator 3*b* adapted to rotate said head 3*a* by a speed-reduction box 3*c***.

A pair of lower and upper semicircular shells **4*a* and 4*b* constitute a continuous wire guide 4. The upper semicircular shell 4*b* is driven by a power cylinder 6 through a piston rod 6*a*** thereof, so as to pivot on a pivot pin 5 and thereby to open or close the lower semicircular shell 4a.

Figure 2:
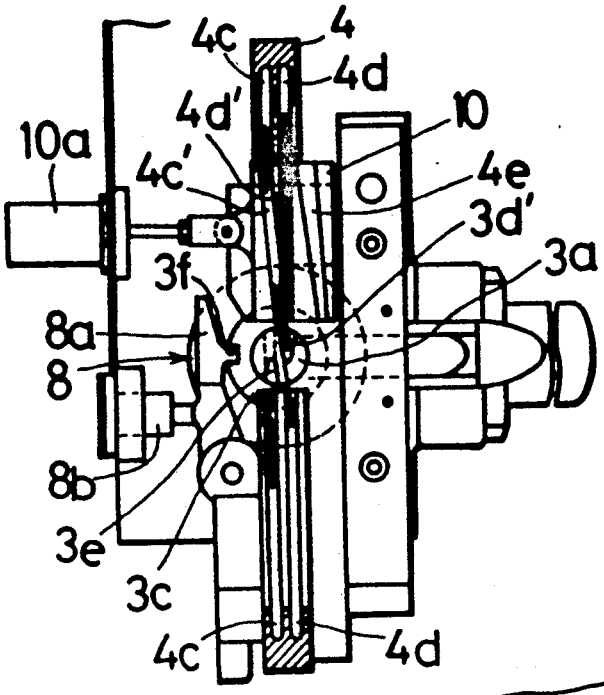
FIG. 2 is a cross section taken along a line II—II in FIG. 1 and showing a switchover device in the embodiment.
Figure 3:
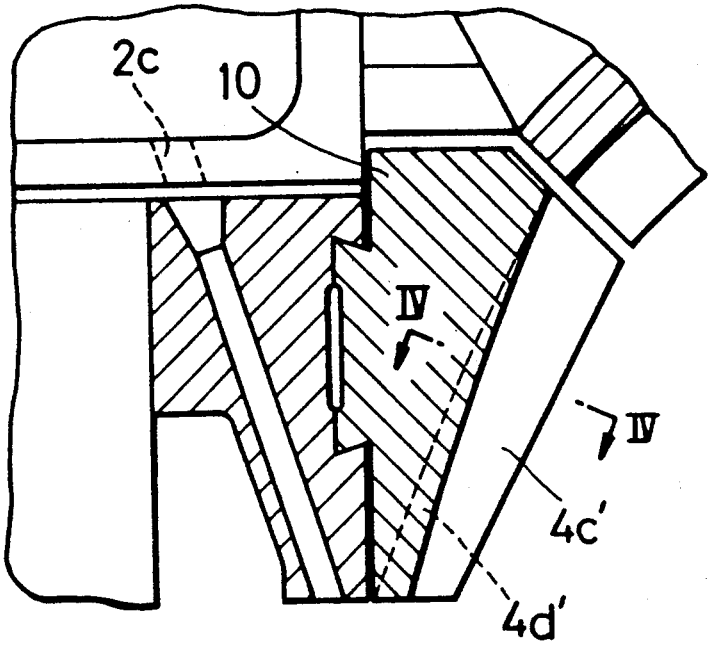
FIG. 3 shows, on an enlarged scale, the switchover device.

With the lower shell 4a closed by the upper shell 4b, a main portion of the above-mentioned continuous wire guide 4 is formed to comprise a first annular passageway 4c and a second annular passageway 4d which extend along an inner peripheral surface of said wire guide 4, as shown in FIG. 2.

The twisting head 3a and a switchover device 10 are, as shown in FIGS. 1 and 2, interposed between opposite ends of the lower and upper shells 4a and 4b so as to complete the continuous wire guide 4.

Figure 8:
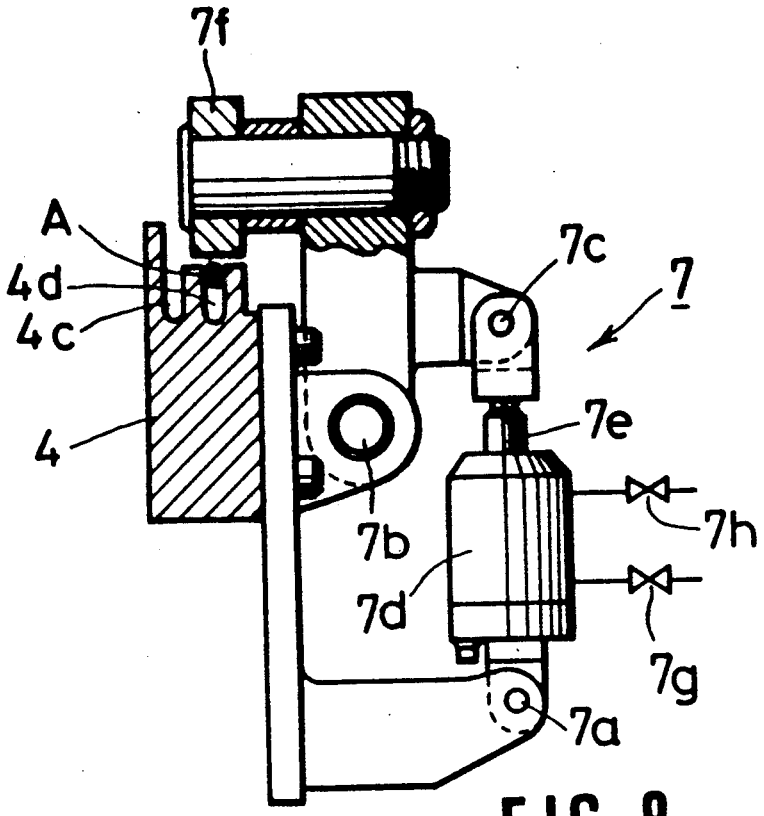
FIG. 8 is a cross section taken along a line VIII—VIII in FIG. 1 and showing a part of stretching means.

A plurality of guiding devices 7 are disposed along the wire guide 4 and spaced apart an appropriate distance from each other. Each guiding device 7 shown in FIG. 8 comprises a roller 7f rotatably carried by an arm which can pivot on a pivot pin 7b. An actuator 7d which may be a hydraulic or pneumatic cylinder has a base portion pivotably supported by a pivot pin 7a on a bracket extending from the wire guide 4. If a piston rod 7e is retracted by charging compressed oil through a valve 7h into the cylinder 7d and at the same time discharging oil therefrom through another valve 7g, the rod 7e pulls the arm rightwardly by means of a pin 7c to displace the roller 7f, thus releasing the wire "A" from the second annular passageway 4d.

Figure 9:
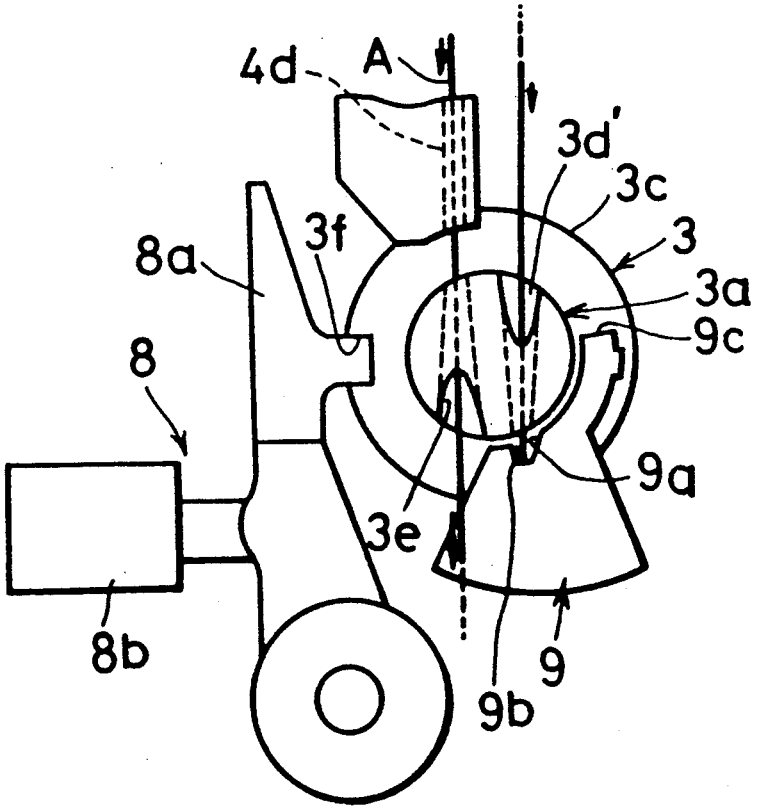
FIG. 9 is an enlarged front view of parts of detecting means and of cutting means, seen from a line IX—IX in FIG. 1.

The twisting head 3a has a groove 3f, as shown in FIGS. 2 and 9 with which a protrusion of a stopper 8 engages to retain said head stationary until the twisting of the ends of the binding wire is started. The stopper 8a and an actuator 8b therefor constitute a holding mechanism 8.

Detecting means and cutting means are embodied in a bending cutter 9 shown in FIG. 9. A recess 9a of the cutter 9 is adapted to detect collision therewith of a leading end of the wire "A", and comprises a side wall 9b which bends said leading end to be retained by a surface of the twisting head 3a when said cutter 9 is rotated counterclockwise along the surface of said head 3a. A cutting blade 9c formed integral with the cutter 9 is provided to cut a trailing end of the wire "A" after said leading end thereof has been bent and substantially at the same time as the twisting of the ends of the wire starts.

Figure 4:
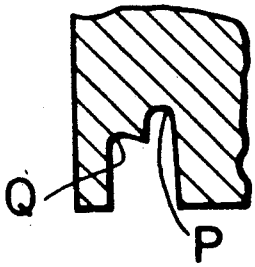
FIG. 4 is another cross section taken along a line IV—IV in FIG. 3.

A switchover device 10 will now be described referring to FIGS. 2 and 5. A second actuator 10a such as an oil-hydraulic cylinder shifts the switchover device 10 from a first position shown in FIG. 2 to a second position shown in FIG. 5, and vice versa. At the first position of said device 10 a first guiding way thereof comprising an oblique passage 4c' and a straight passage 4d' is interposed between an upper end of the wire guide 4 and the twisting head 3a. This state is such that an upper end of the first annular passageway 4c is connected, by means of the oblique passage 4c', to a lower end of the second annular passageway 4d, wherein said head 3a is by-passed by the wire "A" being shifted from an inner deeper bottom "P" to an outer shallower bottom "Q" of the first passageway 4c as is shown in FIG. 4.

Figure 6:
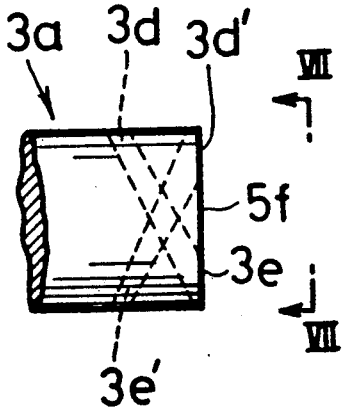
FIG. 6 is an enlarged side view of a twisting head in the embodiment.
Figure 7:
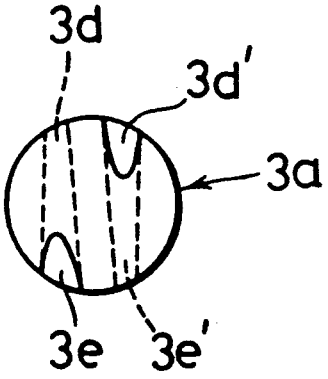
FIG. 7 is an enlarged front view of the twisting head, seen from a line VII—VII in FIG. 6.

On the other hand, at the second position of the switchover device 10, a further oblique passage 4e of said device 10 connects the upper end of said first annular passageway 4c to a second opening of said twisting head 3a. The second opening extends through said head, and comprises an inlet 3d' and an outlet 3e' shown in FIGS. 6 and 7. The twisting head 3a also comprises a first opening which extends through said head and between an inlet 3d and an outlet 3e.

Figure 11:
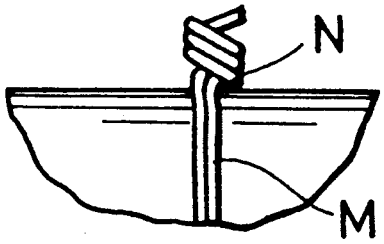
FIG. 11 illustrates another knot produced from two loops of the binding wire.

In two-loop mode of operation, the binding wire "A" which is forced by the drum 2a in FIG. 1 to advance through the outlet 2c outwardly of the upper compartment of the housing 2 will reach the inlet 3d of said twisting head 3a so as to advance therethrough and then enter the lower end of said first annular passageway 4c. After having made almost one loop along the first passageway 4c, the wire "A" which goes out of the upper end thereof is guided to the lower end of the second annular passageway 4d, by-passing the twisting head 3a. As shown in FIG. 2, the wire "A" which will make another loop "M" along the second passageway 4d will then be guided further by the straight passage 4d' into the inlet 3d' of the opening of said head 3a. The leading end of the wire "A" thus penetrates through said head and is detected by the bending cutter 9, which subsequently rotates to cut the trailing end of said wire. Immediately after the cutting of wire, the protrusion of stopper 8a disengages from the recess 3f, thereby allowing the twisting head to rotate in situ to make a knot "N" of the wire ends as shown in FIG. 11.

It will be understood that stretching means composed of the drum 2a and the guiding devices 7 operates, before the cutting of wire by means of cutter 9, to stretch the wire "A" in the following manner. Upon fixation of the leading end, the drum 2a starts to rotate in a reverse direction. The releasing of the rollers 7f in said guiding devices 7 is effected stepwise in such a manner that the roller 7f of the uppermost device 7 is released in FIG. 1, then the roller 7f of the upper right-hand device is released, subsequently roller 7f of the lower right-hand device is released, and finally, said roller 7f of the lower left-hand device 7 is released.

Figure 5:
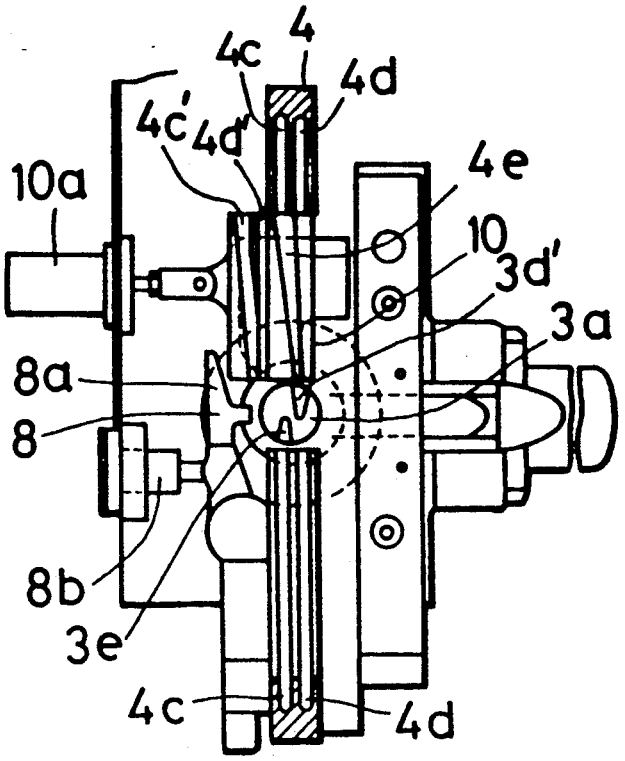
FIG. 5 is a cross section corresponding to FIG. 2 and illustrating a shifted position of the switchover device.
Figure 10:
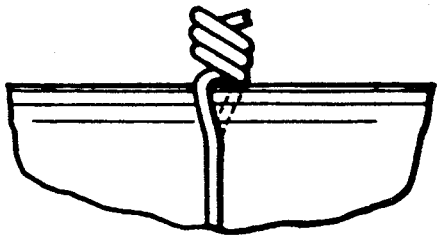
FIG. 10 illustrates a knot produced from one loop of a binding wire.

In one-loop mode of operation to make a knot as shown in FIG. 10, the switchover device 10 is shifted to take its second position shown in FIG. 5. In this case, the leading end of the binding wire "A" which has just made one loop around the elongate articles is bent to be fixed on the twisting head 3a.

Then, the cutting of the trailing end and the twisting of the leading and trailing ends of the binding wire "A" take place similarly to the manner in the two-loop mode of operation.

As will be understood from the foregoing description, the binding machine in the invention is advantageous in that changeover between the operation modes can be made quickly and easily according to the conditions in respect of the characteristics of said elongate articles and/or said binding wire. One-loop mode will be more preferable from the viewpoints of efficiency of the binding works and of running cost thereof.

After the binding work has been completed, the upper shell 4b is opened to discharge a bundle of the thus bound elongate articles.

What is claimed is:

1. A binding machine comprising: a pair of semicircular shells forming a continuous wire guide including a first annular passageway and a second annular passageway, one of the semicircular shells pivoting on an axis to openably close the other semicircular shell so as to form said continuous wire guide; feeding means for feeding a binding wire to the wire guide; detecting means for detecting a leading end of the binding wire when the leading end has passed the continuous wire guide; stretching means for stretching the binding wire after the leading end of said wire has been fixed to a surface portion of a twisting head; cutting means for cutting a trailing end of the binding wire, the trailing end being positioned at the surface portion of the twisting head; twisting means for twisting said leading end and said trailing end of the binding wire, the twisting means comprising the twisting head and a first actuator for rotating said twisting head, said twisting means adapted to twist said ends together simultaneously when the cutting means cuts said trailing end; a switchover device located adjacent to the twisting head and comprising a first guiding way and a second guiding way, the switchover device being moved fore and aft relative to the twisting head by means of a second actuator, so as to make a switchover between a first position and a second position of said switchover device, wherein the first position of said switchover device causes the first guiding way thereof to be aligned with both of the first and second annular passageways, while the second position of said switchover device causes the second guiding way to be aligned only with the first annular passageway of said annular wire guide.

2. A binding machine as defined in claim 1 wherein the first guiding way of said switchover device comprises an oblique passage and a straight passage, the oblique passage connecting an upper end of the first annular passageway to a lower end of the second annular passageway, whereas the second guiding way of said switchover device comprises a further oblique passage which connects the upper end of said first annular passageway to an inlet of an opening penetrating the twisting head.

* * * * *